US006092930A

United States Patent [19]

Kelley et al.

[11] Patent Number: 6,092,930

[45] **Date of Patent: *Jul. 25, 2000**

[54] SELF-CLOSING SEALABLE VALVE BAG

[75] Inventors: Robert G. Kelley, South Jordan; Don G. Giles; Christopher S. Wadium, both of Salt Lake City; Michael R. Avila, West Jordan; Robert F. Kendall, Salt Lake City, all of Utah; Thomas L. Myers, Fountain Valley, Calif.; Mark D. Belser, Long Beach, Calif.; John P. Fuller, Los Angeles, Calif.; Michael D. Abar, Corona, Calif.

[73] Assignee: Stone Container Corporation, Chicago, Ill.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 09/052,411

[22] Filed: Mar. 31, 1998

Related U.S. Application Data

[63] Continuation of application No. 08/644,377, May 10, 1996, Pat. No. 5,806,982, which is a continuation-in-part of application No. 08/240,131, May 10, 1994, Pat. No. 5,516,210.

[51] Int. Cl.[7] ..... B65D 30/26

[52] U.S. Cl. ..... 383/54; 383/44; 383/46

[58] Field of Search ..... 383/53, 54, 48, 383/44, 46

[56] References Cited

U.S. PATENT DOCUMENTS

| | | | |
|---|---|---|---|
| 2,147,970 | 2/1939 | Du Bois . | |
| 3,130,897 | 4/1964 | Poklukar et al. . | |
| 3,191,850 | 6/1965 | Niemeyer . | |
| 3,235,169 | 2/1966 | Gennerich et al. | 383/48 |
| 3,261,267 | 7/1966 | Becker . | |
| 3,295,738 | 1/1967 | Keuchenius et al. | 383/54 X |
| 4,049,191 | 9/1977 | Stearley . | |
| 4,166,482 | 9/1979 | Sanders . | |
| 4,367,620 | 1/1983 | Fox . | |
| 4,382,538 | 5/1983 | Wilharm | 383/54 |
| 4,391,404 | 7/1983 | Welter . | |
| 4,453,270 | 6/1984 | Donini et al. . | |

(List continued on next page.)

FOREIGN PATENT DOCUMENTS

| | | | |
|---|---|---|---|
| 34606/71 | 10/1975 | Australia . | |
| 0 498 047 | 11/1991 | European Pat. Off. . | |
| 1551163 | 12/1968 | France | 383/48 |
| 2228004 | 11/1974 | France . | |
| 2303727 | 10/1976 | France . | |
| 2 596 732 | 10/1987 | France . | |
| 2 218 867 | 10/1973 | Germany . | |
| 7 513 976 | 12/1975 | Germany . | |
| 25 19 494 | 11/1976 | Germany . | |
| 32 03 187 | 8/1983 | Germany . | |
| 7611188 | 4/1977 | Netherlands | 383/48 |
| PCT/F191/00302 | 4/1992 | WIPO . | |

OTHER PUBLICATIONS

Page from Windmoeller and Hollscher catalog (unnumbered) identifying polyethylene tubular valve, purportedly from 1974.

Photo No. 1—Propped–up photo of a polyethylene tubular valve, of the type purportedly manfactured and sold at least as early as May 9, 1993.

Photo No. 2—Photo of a polyethylene "double trap" valve, of the type purportedly manufactured and sold at least as early as May 9, 1993.

(List continued on next page.)

*Primary Examiner*—Jes F. Pascua
*Attorney, Agent, or Firm*—Dick and Harris

[57] ABSTRACT

A valve bag is provided having a self-closing feature to preclude sifting losses after filling, but before the bag is fully sealed, while enabling the facilitated final secure closure of the bag.

21 Claims, 5 Drawing Sheets

U.S. PATENT DOCUMENTS

| | | | |
|---|---|---|---|
| 4,759,640 | 7/1988 | Gröner . | |
| 5,098,201 | 3/1992 | Jacobi | 383/48 |
| 5,516,210 | 5/1996 | Kelley et al. . | |
| 5,806,982 | 9/1998 | Kelley et al. | 383/54 |

OTHER PUBLICATIONS

Photo No. 3 —Photo of a sealable paper valve tube, having an inner coating of activatable adhesive of the type purportedly manufactured and sold at least as early as May 9, 1993.

Photo No. 4—Propped–up photo of a polyethylene tubular valve of the type purportedly manufactured and sold by Bemis Company Inc., of Cordova, Tennessee, at least as early as May 9, 1993.

Photo Nos. 5 and 6—Photos of a valve structure incorporating the polyethylene tubular valve of Photo No 4, to which a rectangular piece of bleached (white) kraft paper has been adhesively affixed. This structure was purportedly manufactured and sold at least as early as May 9, 1993.

Photos Nos. 7–11—Series of photos of a bag incorporating the valve structure of Photos Nos. 5 and 6. This bag–valve structure was purportedly manufactured and sold by Union Camp (now International Paper) at least as early as May 9, 1993.

Photo No. 12—Photo of a bag incorporating the valve structure of Photo Nos. 5 and 6. This type of valve bag structure was purportedly manufactured and sold at least as early as May 9, 1993.

FIG. 9
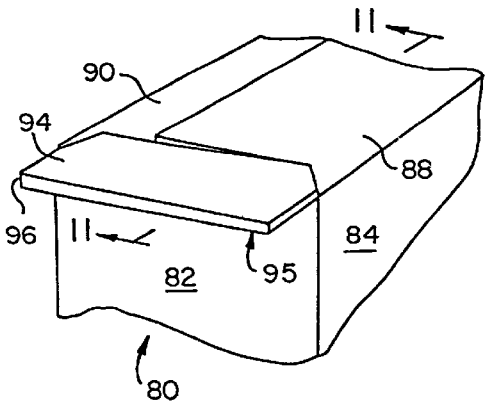
FIG. 10
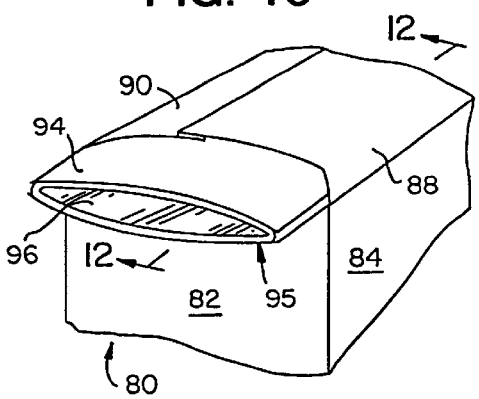
FIG. 11
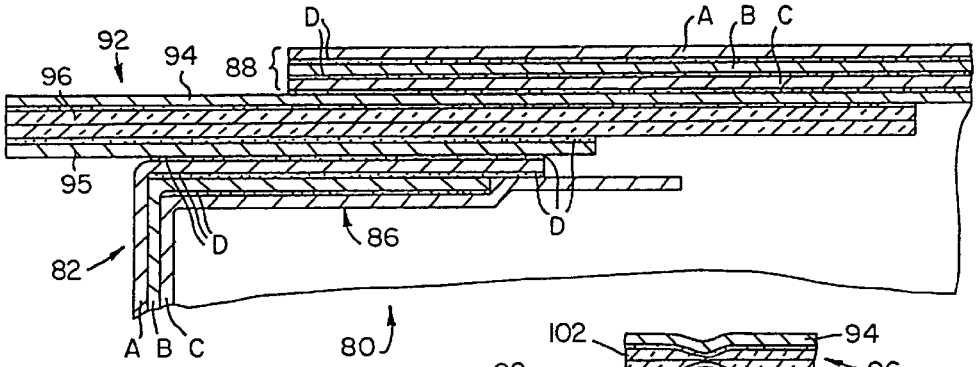
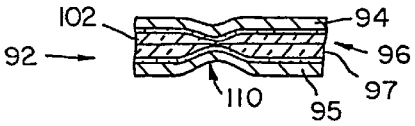
FIG. 13
FIG. 12
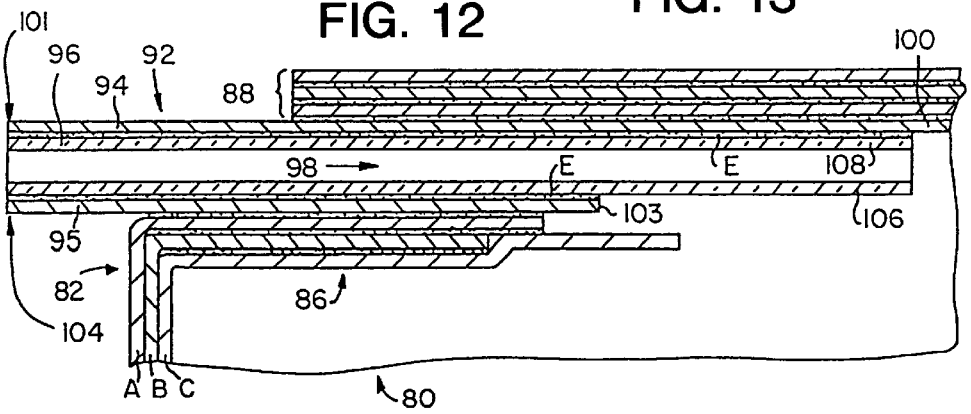

SELF-CLOSING SEALABLE VALVE BAG

This is a continuation of application Ser. No. 08/644,377, filed May 10, 1996, now U.S. Pat. No. 5,806,982, which in turn was a continuation-in-part application of Ser. No. 08/240,1 31, filed May 10, 1994, now U.S. Pat. No. 5,516, 210.

BACKGROUND OF THE INVENTION

1. Field of the Invention

The present invention is directed to bags for transporting materials, in particular, to valve bags.

2. Background Art

A valve bag is a container having a body portion of substantially tubular configuration, which typically has an outer layer of at least one ply, and an inner layer of at least one ply. Typically the plies may be made from a relatively stiff and sturdy paper material. One end of the bag (usually the end the ultimate consumer opens) may be cut in a stepped end pattern, folded over and sealed, to form what is called a pinch-bottom bag. Alternatively, the end may be formed with two sets of flaps, arranged in opposed pairs. The first pair of opposed flaps are folded inwardly toward one another (in-folded flaps). The two other flaps (outer flaps), typically oriented perpendicular to the in-folded flaps, would be folded over the already folded flaps and glued in place to close that end of the bag, such that when the bag is filled, the bottom of the bag will assume a square-bottomed shape.

Rather than leave the opposite end of the bag completely open for filling by the manufacturer/purchaser of the unfinished bag, the bag end can be filled with the opposite (purchaser) end of the bag substantially closed, so long as a valve is provided. In a valved bag, the purchaser end is closed in the second manner described above. The tubular bag form is flattened somewhat, and the in-folded flaps correspond to the two opposite "short" sides of the bag. The in-folded flaps may or may not overlap. The outer flaps, which correspond to the "long" sides of the bag, are then folded over one another, and glued to each other. In addition, one of the in-folded flaps may be glued to the outer flaps. The remaining in-folded flap is not glued to either the outer flaps or the other in-folded flap, and so a channel can be formed, upon outward deflection of the glued and overlapped outer flaps, leading to the interior of the bag. If the in-folded flaps overlap, the valve is located on the side of the "under" flap. Filling can be accomplished by the insertion of an appropriately configured nozzle, which will extend to the gap between the in-folded flaps, to drop material into the interior of the bag, or if the in-folded flaps overlap, the nozzle will project under the "over" flap and into the bag far enough to clear the "under" flap and access the interior of the bag.

There are two general kinds of valved bags, those which cannot be sealed, and those which can be sealed. The bag previously described, is an unsealed bag, as once filling has been accomplished, there can be no further gluing, or other sealing procedure which can be done without potentially disturbing or contaminating the contents of the bag, since the gap between the outer flaps and the unglued in-folded flap would have to be re-opened to place a seal between them.

To help prevent sifting outwardly from such bags, a lining material, typically a soft polyethylene film, is placed in the interior of the valve region. The film is generally formed as a short tube, and is configured such that the film extends toward the opposite side of the bag farther than the adjacent in-folded flap, such that the contents will press against the film, pushing the film against the outer flap, and precluding sifting, particularly when the bag is laid on its side or inverted. Such a bag is exemplified by the Film-loc valve bag, manufactured by Stone Container Corporation. While sifting, dusting and spillage are not eliminated by such a bag, the losses are substantially reduced to a level acceptable for many uses of such bags. Neither are such bags fully sealed, against infiltration of material from the outside into the interior of the bag.

In some instances, it is desirable to be able to fully seal the bag, after filling by the valve method. Accordingly, an outwardly extending valve tube has been provided in some prior art bags, such as disclosed in Donini et al., U.S. Pat. No. 4,453,270. In such a bag, the valve extension is a tube, formed from the stiff paper bag material previously described. The tube is positioned inside the valve area, so as to extend outwardly, well past the side of the bag, and inwardly, to a position substantially even with the inner edge of the valve side in-folded flap. The inner surfaces of the tube are coated with an adhesive/sealing material, such as a heat activatable glue, or an adhesive which may be activated by ultrasonic means. During the filling process, the valve tube is opened, and a filling nozzle is inserted. Due the stiffness of the combined paper and sealing in the sealer, the valve tube may tend to remain slightly open, even after removal of the filling nozzle.

Once filled, the valve is typically flattened, and the end of the valve tube is sealed, either by application of heat or ultrasonic vibrations, to activate the sealing adhesive. In other valve tube bag constructions, a tab on the "upper" portion of the outwardly extending tube extends further than the "lower" portion, and instead of relying upon an adhesive lined tube, an applicator puts a hot melt glue on the underside of the tab, and a wiper presses the valve tube downward against the side of the filled bag, simultaneously closing the bag and affixing the tube against the bag side.

Prior art processes for filling and closing or sealing such bags having outwardly extending valve tubes involve the closing/sealing of the bags in the immediate vicinity of the packing apparatus which filled the bag. The bag is then transported from the location after closing and sealing. Such procedures, however, require that each packing apparatus be provided with its own sealing apparatus.

The trend in manufacturing processes now, however, particularly with extended valve tube bags, is not to provide one sealing apparatus per packing apparatus, since it requires less capital expense to use only one or two sealing apparatus for a packaging line, and the line speed can also be increased if common sealing apparatus are used for all the packing apparatus. The difficulty lies in that the filled, but unclosed and unsealed bags must be transported by conveyer to the sealing apparatus location. The bags may typically be dropped onto a conveyer.

Due to the stiffness of the valve tube material, as mentioned, the valve tube tends to remain open somewhat, as the bag is dropped onto the conveyer, leading to unacceptable spillage and dusting. In addition, the operation of the sealing apparatus may require that the bag be tipped from an upright position, to a position on its side, further leading to the possibility of dusting and spillage.

It is an object of the present invention, therefore to provide a valve bag construction, for sealable valve bags, which is suitable for efficient use in new packaging lines having only one or two sealing apparatus for a plurality of filling apparatus.

Still another object of the invention is to provide a valve bag construction for sealable valve bags, in which spillage and dusting can be controlled.

These and other objects of the invention will be come apparent in light of the present specification, claims and drawings.

SUMMARY OF THE INVENTION

The present invention is a valve bag apparatus, for the containment of material, having a generally tubular bag body portion, having a valve end portion, said bag body portion including a front side panel; at least one in-folded flap member, operably disposed in said valve end portion and extending from said front side panel inwardly into an interior region of said valve bag apparatus; and at least one outer flap member, operably disposed in said valve end portion, and folded to a position over and to the outside of said at least one in-folded flap member, at least one of said at least one outer flap member being unadhered to at least one of said at least one in-folded flap member, so as to provide a valve passage therebetween said at least one in-folded flap member and said at least one outer flap member, from a region exterior to said valve bag apparatus to said interior region of said valve bag apparatus.

The valve bag apparatus also includes a valve tube member operably positioned and affixed within said valve passage. The valve tube member has at least one valve tube support member, operably affixed to at least one of said at least one in-folded flap member and at least one of said at least one outer lap member. The at least one valve tube support member has a first end substantially protruding exteriorly from said front side panel of said valve bag apparatus. Valve liner means are operably supported by said at least one valve tube support member, for providing sealing of said valve bag apparatus. The valve liner means has a first end positioned adjacent to said first end of said at least one valve tube support member so as to likewise substantially protrude exteriorly from said front side panel of said valve bag apparatus, and a second end extending inwardly, to a position opening within said interior region of said valve bag apparatus. Means for precluding escape of said material from said valve bag apparatus, after filling of said valve bag apparatus with said material but prior to sealing of said valve bag apparatus at a location outwardly from said front side panel, are operably associated with the valve tube member.

In a preferred embodiment of the invention, the valve liner means includes at least one tubular liner member, fabricated from a sealable material, operably disposed in said valve passage and affixed to said at least one valve tube support member. The at least one tubular liner member is preferably fabricated from a polyethylene film, which is capable of being sealed by application of heat. Alternatively, the at least one tubular liner member is fabricated from a polyethylene film, which is capable of being sealed by application of ultrasonic vibrations.

In a preferred embodiment of the invention, the means for precluding escape of said material from said valve bag apparatus, after filling of said valve bag apparatus with said material but prior to sealing of said valve bag apparatus comprises at least a first portion of said valve liner means, operably positioned in said valve passage, facing said interior region of said valve bag apparatus, and operably configured, such that after filling of said valve bag apparatus, said first portion of said valve liner means closes against a second portion of said valve liner means, to close off said valve passage to preclude escape of said filled material from said valve bag apparatus, prior to sealing thereof at said location protruding externally from said front side panel.

The at least one valve tube support member preferably comprises one or more first valve tube support members, being operably affixed to a surface of said valve liner means, between said valve liner means and said at least one outer flap member, as well as one or more second valve tube support members, operably affixed to another surface of said valve liner means, between said valve liner means and said at least one in-folded flap member. The one or more first valve tube support members and the one or more second valve tube support members all have first ends positioned adjacent one another, at the position protruding substantially exteriorly to the front side panel of the valve tube support members having second ends extending inwardly toward the interior region of the valve bag apparatus, the one or more second valve tube support members having second ends extending inwardly toward the interior region of the valve bag apparatus. The second ends of said one or more first valve tube support members extend inwardly substantially further than the second ends of the one or more second valve tube support members. A portion of the valve liner means facing the interior region of the valve bag apparatus is unsupported by any valve tube support member, such that after filling of the valve bag apparatus with material, the portion of said valve liner means is free to approach and position itself against an opposed portion of the valve liner means to preliminarily substantially close the valve passage prior to sealing of the valve bag apparatus.

The invention also comprises, a valve bag apparatus, for the containment of material, comprising a generally tubular bag body portion, having a valve end portion, said bag body portion including a front side panel. At least one in-folded flap member is disposed in said valve end portion and extending from said front side panel inwardly into an interior region of said valve bag apparatus. At least one outer flap member is disposed in said valve end portion, and folded to a position over and to the outside of said at least one in-folded flap member, at least a portion of said outer flap member being unadhered to at least a portion of said in-folded flap member, so as to provide a valve passage therebetween said at least one in-folded flap member and said at least one outer flap member, from a region exterior to said valve bag apparatus to said interior region of said valve bag apparatus.

The valve bag apparatus further comprises a valve tube member positioned and affixed within said valve passage. The valve tube member includes at least one valve tube support member, affixed to at least one of said at least one in-folded flap member and at least one of said at least one outer flap member. The at least one valve tube support member has a first end substantially protruding sideways, exteriorly relative to said front side panel of said valve bag apparatus, and a second end extending into said valve passage.

Valve liner means are supported by said at least one valve tube support member, for providing sealing of said valve bag apparatus. The valve liner means has a first end positioned substantially proximate to said first end of said at least one valve tube support member so as to likewise substantially protrude sideways, exteriorly relative to said front side panel of said valve bag apparatus, and a second end extending inwardly, to a position opening within said interior region of said valve bag apparatus. Means are disposed within and substantially support by said valve tube member and positioned substantially adjacent the second end of the valve tube support member, for precluding escape of said material from said valve bag apparatus, after filling of said valve bag apparatus with said material but prior to sealing of said valve bag apparatus at a location outwardly from said front side panel.

The valve liner means comprise at least one tubular liner member, fabricated from a sealable material, disposed in the valve passage and affixed to the at least one valve tube support member. The at least one tubular liner member is fabricated from a polyethylene film, which is capable of being sealed by application of heat, in one embodiment. In another embodiment, the at least one tubular liner member is fabricated from a polyethylene film, which is capable of being sealed by application of ultrasonic vibrations.

The means for precluding escape of the material from the valve bag apparatus, after filling of the valve bag apparatus with the material but prior to sealing of the valve bag apparatus comprises at least a portion of the valve liner means positioned in the valve passage, facing the interior region of the valve bag apparatus, and configured, such that after filling of the valve bag apparatus, the first portion of the valve liner means closes against a second portion of the valve liner means, to close off the valve passage to preclude escape of the filled material from the valve bag apparatus, prior to sealing thereof at the location protruding externally from the front side panel.

The at least one valve tube support member comprises at least one first valve tube support member, being affixed to a surface of the valve liner means, between the valve liner means and the at least one outer flap member; and at least one second valve tube support member, affixed to another surface of the valve liner means, between the valve liner means and the at least one in-folded flap member.

In one embodiment, the at least one first valve tube support member and the at least one second valve tube support member all have first ends positioned adjacent one another, at the position protruding substantially exteriorly to the front side panel of the valve bag apparatus, and the at least one first valve tube support member has a second end extending inwardly toward the interior region of the valve bag apparatus, while the at least one second valve tube support member has a second end extending inwardly toward the interior region of the valve bag apparatus. The second end of the at least one first valve tube support member extends inwardly substantially further than the second end of the at least one second valve tube support member. A portion of the valve liner means facing the interior region of the valve bag apparatus being unsupported by any valve tube support member, such that after filling of the valve bag apparatus with material, the portion of the valve liner means is free to approach and position itself against an opposed portion of the valve liner means to preliminarily substantially close the valve passage prior to sealing of the valve bag apparatus.

The means for precluding escape of said material from said valve bag apparatus preferably comprises a portion of said valve liner means facing said interior region of said valve bag apparatus being unsupported by any valve tube support member, such that after filling of said valve bag apparatus with material, said portion of said valve liner means is free to approach and position itself against an opposed portion of said valve liner means to preliminarily substantially close said valve passage prior to sealing of said valve bag apparatus.

In one embodiment, a portion of said at least one valve tube support member is positioned between said portion of said valve liner means facing said interior region of said valve bag apparatus and being unsupported by any valve tube support member, and said interior region of said valve bag apparatus. In another embodiment, no portion of said at least one valve tube support member is positioned between said portion of said valve liner means facing said interior region of said valve bag apparatus and being unsupported by any valve tube support member, and said interior region of said valve bag apparatus.

In one embodiment, the at least one first valve tube support member and the at least one second valve tube support member are formed from separate sheets of material. In another embodiment, the at least one first valve tube support member and the at least one second valve tube support member are formed from a single monolithic sheet of material.

The at least one first valve tube support member and the at least one second valve tube support member, in one embodiment, each have a first end substantially protruding sideways, exteriorly relative to the front side panel of the valve bag apparatus, wherein the first end of the at least one second valve tube support member protrudes further outwardly than the first end of the at least one first valve tube support member.

BRIEF DESCRIPTION OF THE DRAWINGS

FIG. 9 is a perspective view of the valve bag, according to the present invention, with the valve closed;

FIG. 10 is a perspective view of the valve bag of FIG. 9, with the valve partially open;

FIG. 11 is a side elevation in section, of the valve bag of FIG. 9, with the valve closed;

FIG. 12 is a side elevation in section, of the valve bag of FIG. 9, with the valve partially open;

FIG. 13 is a side elevation in section, of the valve tube external end, shown after sealing;

BEST MODE FOR CARRYING OUT THE INVENTION

Figure 1:
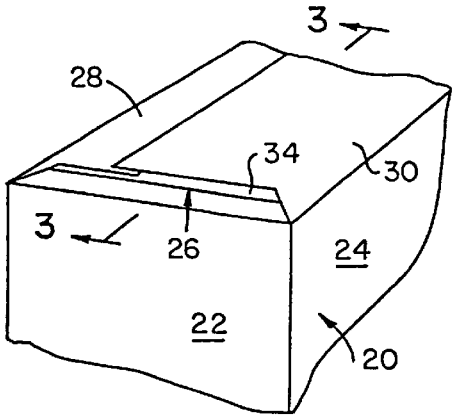
FIG. 1 PRIOR ART
FIG. 1 is a perspective view of a prior art valve bag, with the valve closed.
Figure 2:
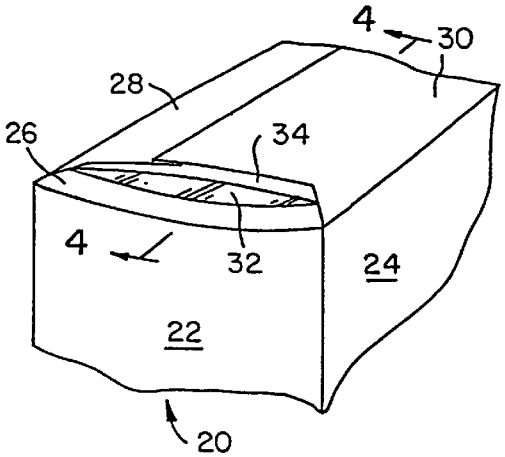
FIG. 2 PRIOR ART
FIG. 2 is a perspective view of the prior art valve bag of FIG. 1, with the valve partially open.

While the present invention is susceptible of embodiment in many different forms, there will be described herein in detail, a specific embodiment, with the understanding that the embodiment illustrated is to be considered as an exemplification of the principles of the invention, and is not intended to limit the invention to the embodiment illustrated.

Prior art non-sealable valve bag 20 is illustrated in FIGS. 1–4. For economy of illustration, only the valve corner of the valve end of bag 20 is shown, as the remainder of the construction of bag 20 is known in the art, and not relevant to the present invention. Bag 20 includes side walls 22, 24, in-folded flap 26, and outer flaps 28, 30. Bag 20 also includes valve liner 32 and valve reinforcement member 34. In the process of making bag 20, before outer flaps 28, 30 are folded down and glued into place, valve liner 32 and valve reinforcement member 34 are positioned and affixed onto in-folded flap 26 of bag 20. Valve liner 32 is in the form of a tube, and has valve reinforcement member 34 adhered to its upper side, and has valve reinforcement member 34 is placed lying flat on in-folded flap 26. Once valve liner 32 and valve reinforcement member 34 are in place, then adhesive is applied to the upper side of valve reinforcement member 34, among other areas, and outer flaps 28, 30 are folded over.

Typically, valve liner 32 is formed from a soft polyethylene film, while valve reinforcement member 34 may be a relatively stiff kraft paper material.

Figure 3:
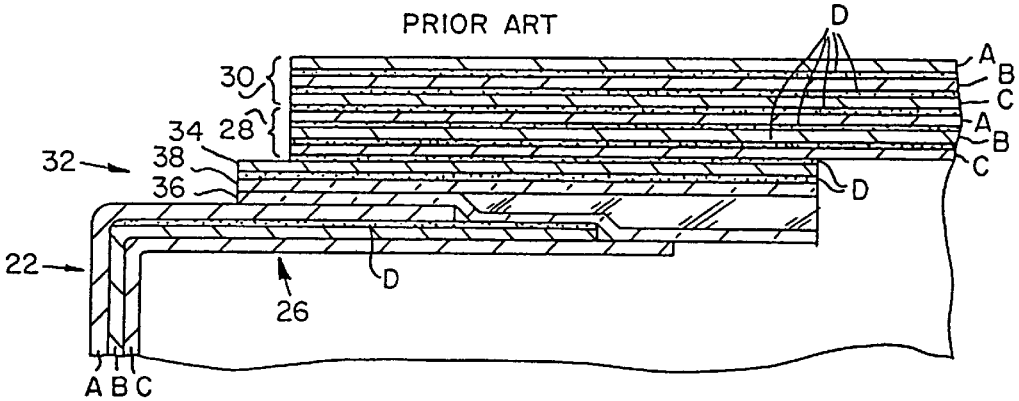
FIG. 3 PRIOR ART
FIG. 3 is a side elevation in section, of the prior art valve bag of FIG. 1, with the valve closed.
Figure 4:
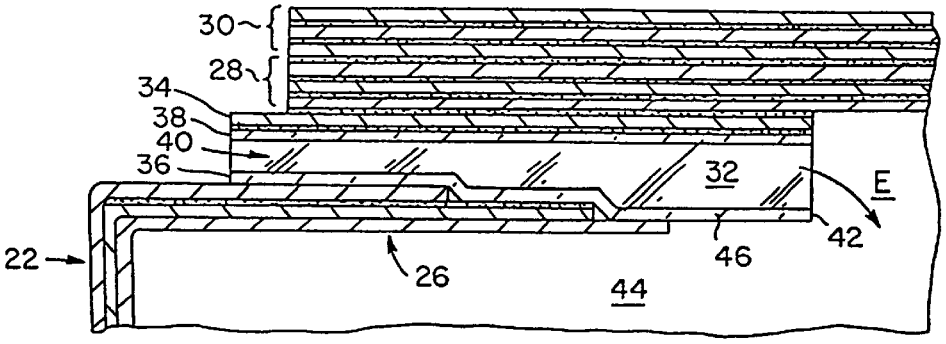
FIG. 4 PRIOR ART
FIG. 4 is a side elevation in section, of the prior art valve bag of FIG. 1, with the valve partially open.
Figure 5:
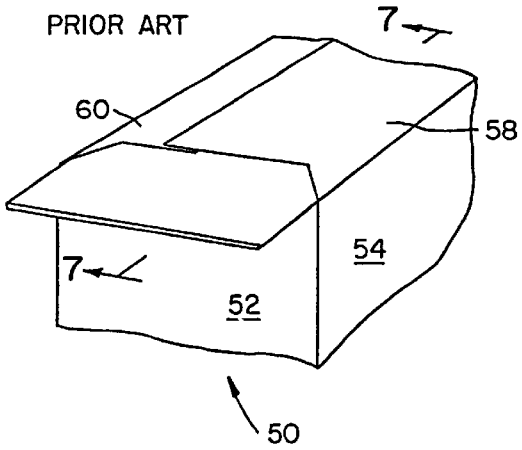
FIG. 5 PRIOR ART
FIG. 5 is a perspective view of a prior art valve bag, with the valve closed.
Figure 6:
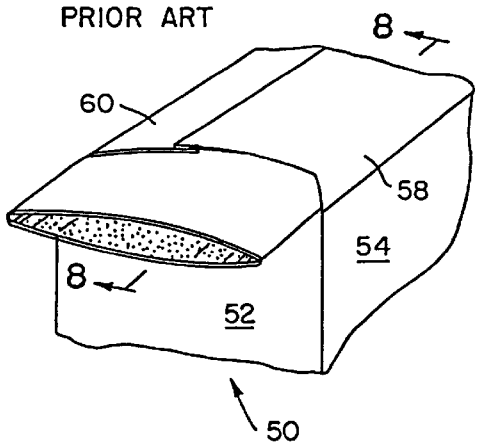
FIG. 6 PRIOR ART
FIG. 6 is a perspective view of the prior art valve bag of FIG. 5, with the valve partially open.
Figure 7:
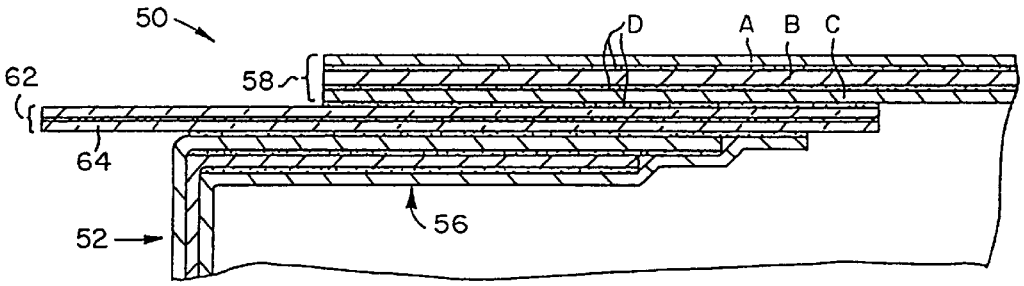
FIG. 7 PRIOR ART
FIG. 7 is a side elevation in section, of the prior art bag of FIG. 5, With the valve closed.
Figure 8:
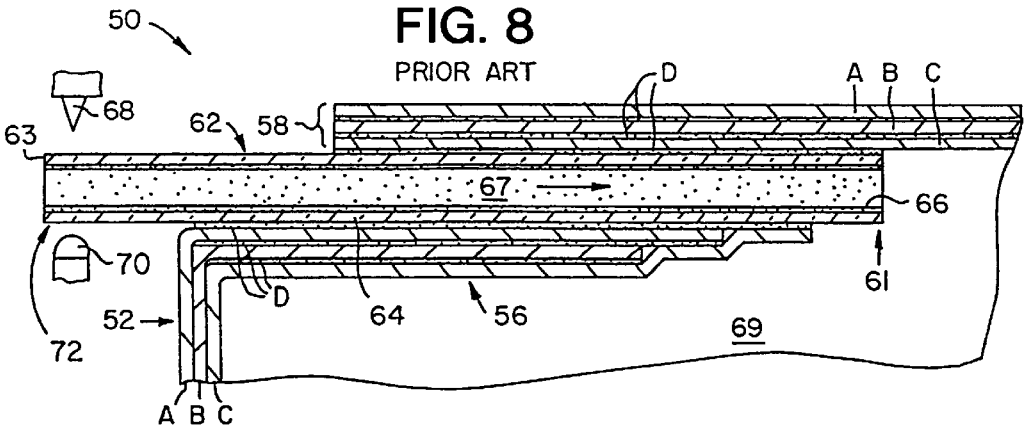
FIG. 8 PRIOR ART
FIG. 8 is a side elevation in section, of the prior art valve bag of FIG. 5, with the valve partially open.
Figure 14:
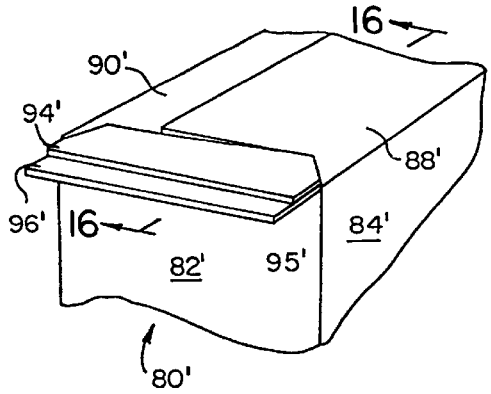
FIG. 14 is a perspective view of an alternative embodiment of the valve bag, according to the present invention, with the valve closed.
Figure 15:
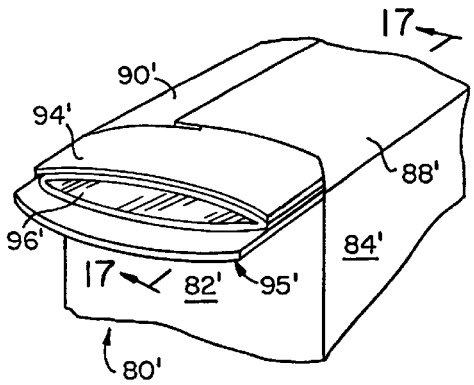
FIG. 15 is a perspective view of the valve bag of FIG. 14, with the valve partially open.
Figure 16:
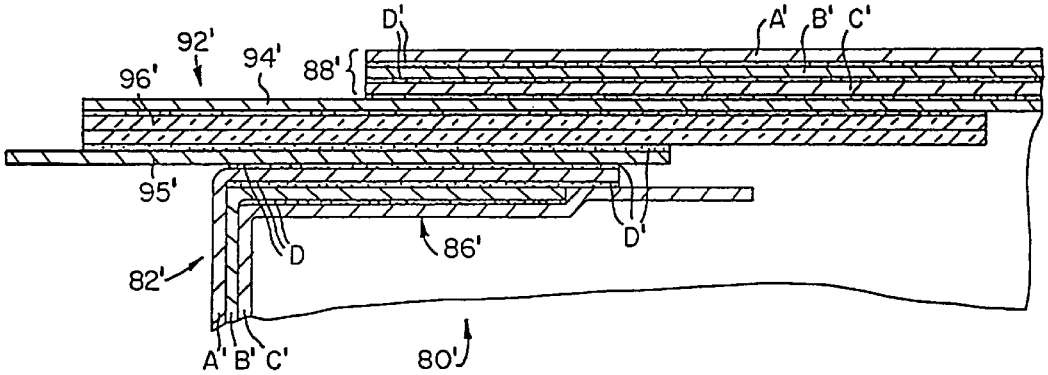
FIG. 16 is a side elevation in section, of the valve bag of FIG. 14, with the valve closed.
Figure 17:
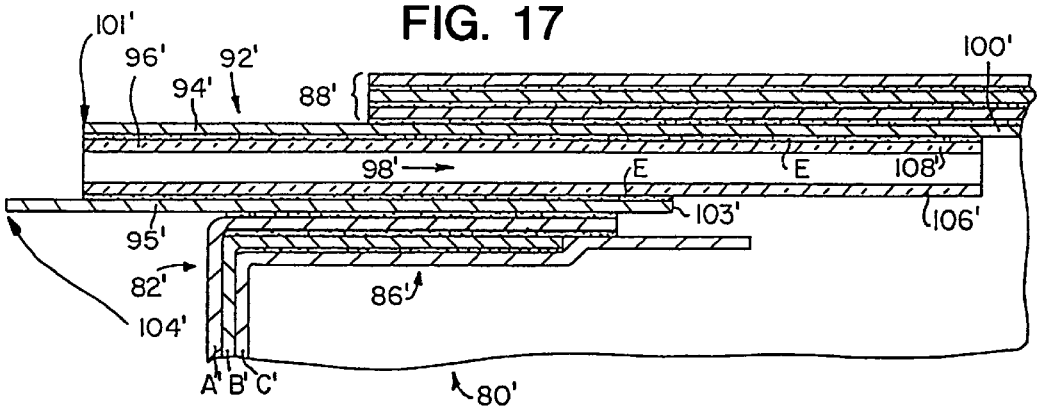
FIG. 17 is a side elevation in section, of the valve bag of FIG. 14, with the valve partially open.

As viewed in section in FIG. 3, valve liner 32, when the valve is closed, comprise a lower side 36 and an upper side 38. Bag 20, including side wall 22, in-folded flap 26, and outer flaps 28, 30, happens to be fabricated from three layers of bag material, outer layer A, and inner layers B and C, although bags having greater or fewer layers are known or contemplated in the prior art. Layers A, B, and C are adhered together, at least in portions of the outer flaps 28, 30 and in-folded flap 26 by adhesive material D.

In order to fill bag 20, a fill nozzle (not shown) is inserted into valve liner 32. Upper side 38 and lower side 36 separate, to provide a valve passage 40 (width of opening not shown to scale). The fill nozzle may typically be inserted into valve liner 32 far enough to extend approximately the inside edge 42 of valve liner 32, where the material exiting the nozzle will fall (the direction of arrow E) into the interior space 44 of bag 20. When bag 20 is filled and the nozzle removed, the material with which bag 20 has been filled will tend to press against the lower side 36 of valve liner 32 at its inner portion 46. Since inner portion 46 of valve liner 32 is not adhered to or backed by in-folded flap 26 or any other stiff material, inner portion 46 will be pressed by the material in the bag 20 against upper side 38 of valve liner 32, closing valve passage 40. However, no seal is formed, and once the bag 20 has been filled, there is no practical method of sealing bag 20 without disturbing or potentially contaminating the contents of the bag.

A prior art valve bag capable of being sealed is shown in FIGS. 5–8. Bag 50 includes side walls 52, 54, in-folded flap 56, and outer flaps 58, 60. As in the other prior art bag 20, prior art bag 50, happens to be fabricated from three layers of bag material, outer layer A, and inner layers B and C, although bags having greater or fewer layers are contemplated in the prior art. Likewise, the layers are adhered, together, at least in portions, by layers of adhesive D. In order to facilitate filling and subsequent sealing of bag 50, valve tube 62 is provided. Valve tube 62 is an integral unit comprising a tube member 64 formed from stiff, relatively thick kraft paper material, and is placed in bag 50 in substantially the same manner as valve liner 32 and reinforcement member 34 were placed in bag 20 during manufacture. Valve tube member 64 has a uniform length, from its inside end 61, to its outside end 63, around its complete circumference. Valve tube member 64 is affixed to in-folded flap 56 and outer flaps 58, 60 by adhesive layer D. Valve tube member 64 is coated on its interior sides with adhesive material 66, which is a glue coating which may be activated by ultrasonic energy.

Filling of bag 50 is accomplished in generally the same manner as was described with respect to the other prior art bag. A nozzle (not shown) is inserted into valve passage 67 (width not shown to scale) and bag filling material is discharged into the interior 69 of bag 50. Upon completion of filling, such prior art bags 50 are sealed at the location of filling, prior to further handling. The typical method of closing and sealing bag 50 is to provide an ultrasonic generator head 68 and anvil 70 combination adjacent to the filling nozzle. The outwardly extending end 72 of valve tube 62 is positioned between the generator head 68 and anvil 70, which then come together, closing end 72, and applying ultrasonic energy to activate adhesive layer 66 to seal the valve tube 62. In order to ensure correct placement of end 72 in the sealing apparatus, valve tube 62 must extend substantially outwardly of side wall 52.

Bag filling systems having sealing apparatus such as generator head 68 and anvil 70 combination adjacent to each filling nozzle have been found to be slower, more costly and generally less efficient, than systems which accomplish the sealing of the bags at a location downstream from the filling apparatus. However, the intermediate handling of the bags which is required by such newer systems leads to sifting, spillage and dusting by the contents of the bags. This is due to the fact that the valve tube members 64 are fabricated of such stiff material that the valve passages 67 tend to remain open somewhat, even if the bags are laid on their sides or inverted (with some of the bag filling material pressing against in-folded flaps 56) in order to facilitate the sealing procedures. Sifting and spillage may still tend to occur through the open portions of the valve passages 67.

The valve bag 80 of the present invention is configured to prevent such sifting and spillage during the handling after filling and prior to sealing. Bag 80, of which only the valve corner of the valve end is shown, the remainder of the bag being contemplated as being of known construction, includes front side panel 82, externally outward from which valve tube 92 extends, side wall 84, and in-folded flap 86, and outer flaps 88, 90. Bag 80 is shown fabricated of three layers of bag material, having an outer layer A, and inner layers B and C, which are adhered together, at least in some portions, by adhesive layers D. Although three layers A, B, and C are shown, valve bags 80 are also contemplated as having a greater or lesser number of layers, and still be within the scope of the present invention. A valve tube 92 is provided, which includes valve tube support members 94 and 95, which are formed from stiff paper material, such as kraft paper. Affixed to the inner surfaces of valve tube support members 94, 95 is valve tube sleeve 96, which, in a preferred embodiment of the invention, is a low density polyethylene film. Adhesive material E is applied throughout the common surface contact area between valve tube support member 95 and sleeve 96, and may be applied in a diamond pattern in the common surface contact area between valve tube support member 94 and sleeve 96. The length of valve tube support member 94, from its inner end 100, to its outer end 101, is greater than the length of valve tube support member 95, from its inner end 103, to its outer end 104, inner end 100 extending at least as far as and preferably farther than sleeve 96.

Bag 80 is filled, again, through the placement of a nozzle (not shown) into valve tube 92, in particular, in sleeve 96, which is opened to form valve passage 98 (width not shown to scale). After filling, the nozzle is withdrawn, and bag 80 is dropped on a conveyer for transport to sealing apparatus. As bag 80 is placed on the conveyer, the filling material (not shown) presses against unsupported inside portion 106 of sleeve 96, which is free to move up to press inside portion 106 against supported outside portion 108 of sleeve 96, closing valve passage 98, with desired minimum amount of sifting or spillage. Sealing of bag 80 may be accomplished in substantially the same manner as described previously, the polyethylene film material of sleeve 96 being susceptible to closure and sealing together with the use of ultrasonic energy, as well as thermal energy, as may be desired.

FIG. 13 shows a sectional view of the external end of valve tube 92, in particular, support member 94 and valve sleeve 96, after sealing, which may be accomplished by the application of heat, or of ultrasonic energy. As can be seen, after sealing, in the vicinity of seal 110, upper layer 102 of valve sleeve 96 has melded with lower layer 97 of valve sleeve 96. In addition, all of the layers of valve tube 92 may be slightly crimped.

An alternative embodiment of the invention is shown in FIGS. 14–17, in which like structural elements to those illustrated in FIGS. 9–13 are provided with like reference numerals, with a prime (').

The valve bag 80' of the embodiment of FIGS. 14–17 is also configured to prevent such sifting and spillage during the handling after filling and prior to sealing. Bag 80', of which only the valve corner of the valve end is shown, the remainder of the bag being contemplated as being of known construction, includes front side panel 82', externally outward from which valve tube 92' extends, side wall 84', and in-folded flap 86', and outer flaps 88', 90'. Bag 80' is shown, like the previous embodiment, to be fabricated of three layers of bag material, having an outer layer A', and inner layers B' and C', which are adhered together, at least in some portions, by adhesive layers D'. Although three layers A', B', and C' are shown, valve bags 80' are also contemplated as having a greater or lesser number of layers, and still be within the scope of the present invention. A valve tube 92' is provided, which includes valve tube support members 94' and 95', which are preferably formed from stiff paper material, such as kraft paper. In the embodiment of FIGS. 14–17, valve tube support member 95' (the lower support member) extends outwardly farther than does support member 94'. Affixed to the inner surfaces of valve tube support members 94', 95' is valve tube sleeve 96', which, in a preferred embodiment of the invention, is a low density polyethylene film. Adhesive material E' is applied throughout the common surface contact area between valve tube support member 95' and sleeve 96', and may be applied in a diamond pattern in the common surface contact area between valve tube support member 94' and sleeve 96'. Valve tube support member 94', to its inner end 100', extends farther into and/or toward the interior region of bag 80' than does valve tube support member 95', to its inner end 103'. Inner end 100' extends at least as far as and preferably farther than sleeve 96' toward and/or into the interior region of bag 80'.

Preferably, valve tube support member 94' and valve tube support member 95' are formed as two separate pieces of material, affixed to respective opposite, outwardly facing sides of tubular sleeve 96', as preferably are members 94, 95 (in the embodiment of FIGS. 9–13) formed from separate pieces of material affixed to respective opposite, outwardly facing sides of sleeve 96. Alternatively, valve tube support members (94, 95 and 94', 95', respectively), may be formed from single sheets of material, cut and rolled to form tubes.

As described previously, bag 80' is filled through the placement of a nozzle (not shown) into valve tube 92', in particular, into sleeve 96', which is opened to form valve passage 98' (width not shown to scale). The extra distance that valve tube support member 95' extends outwardly facilitates the placement of the filling nozzle. Some filling equipment may be provided with outwardly extending vertically moving fingers (not shown) which may be configured to move vertically downward, encountering the extending portion of support member 95', thus pushing support member 95' downward, relative to support member 94', and causing the valve to be opened to receive the filling nozzle. After filling, the nozzle is withdrawn, and bag 80' is dropped on a conveyer for transport to sealing apparatus. As bag 80' is placed on the conveyer, the filling material (not shown) presses against unsupported inside portion 106' of sleeve 96', which is free to move up to press inside portion 106' against supported outside portion 108' of sleeve 96', closing valve passage 98', with desired minimum amount of sifting or spillage. Sealing of bag 80' may be accomplished in substantially the same manner as described previously, the polyethylene film material of sleeve 96' being susceptible to closure and sealing together with the use of ultrasonic energy, and/or thermal energy, as may be desired.

The valve of bag 80' may be sealed in general accordance with the manner described with respect to the sealing of the valve for bag 80 as shown in FIG. 13.

Figure 18:
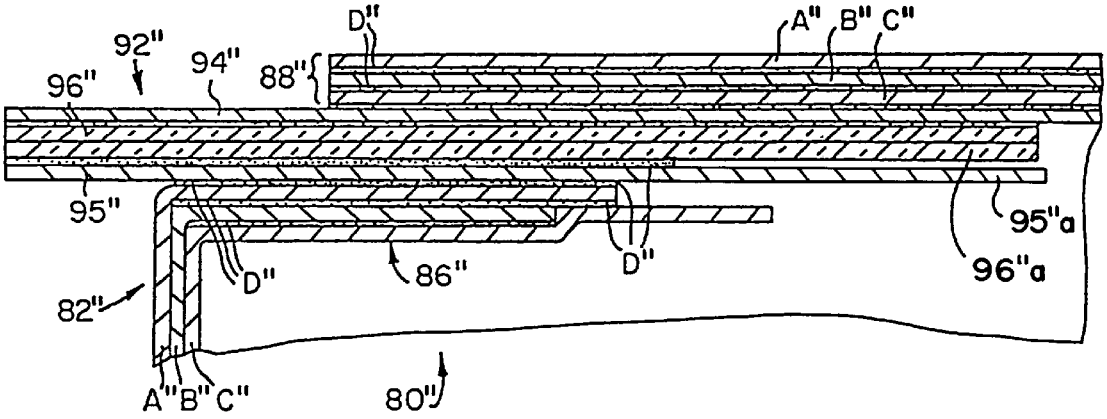
FIG. 18 is a side elevation of a further alternative embodiment of the valve bag according to the present invention, with the valve closed.

A still further alternative embodiment of the invention is shown in FIG. 18, in which like structural elements to those illustrated in FIGS. 9–13, and 14–17 are provided with like reference numerals with a double prime (").

In the embodiment of the invention of FIG. 18, a valve tube may be formed, generally according to the principles of the prior two embodiments, except that the lower valve tube support member 95" may extend inwardly, toward and/or into the interior region of the bag, for a substantial distance, which may even be as great as the distance which the upper valve tube support member 94" extends. However, the inner end 96"*a* of the polyethylene valve sleeve 96" will not be affixed to the inner end 95"*a* of lower valve tube support member 95". In this embodiment, valve tube support member 95" will be present to provide support for the inner end of sleeve 96", so as to prevent undesired random loose sagging, snagging, folding or wrinkling of the sleeve 96" before, during and after filling, but will permit inner end 96"*a* of sleeve 96" to be prompted to close and seal bag 80" by the filling material, in the event that lower valve tube support member 95" should happen to remain in a lower or open configuration, following the filling step.

The foregoing description and drawings merely explain and illustrate the invention, and the invention is not limited thereto, except insofar as the appended claims are so limited, as those skilled in the art who have the disclosure before them will be able to make modifications and variations therein without departing from the scope of the invention.

What is claimed is:

1. A valve bag apparatus, for the containment of material, comprising:

a generally tubular bag body portion, having a valve end portion, said bag body portion including a front side panel;

at least one in-folded flap member, disposed in said valve end portion and extending from said front side panel inwardly into an interior region of said valve bag apparatus;

at least one outer flap member, disposed in said valve end portion, and folded to a position over and to the outside of said at least one in-folded flap member, at least a portion of said outer flap member being unadhered to at least a portion of said in-folded flap member, so as to provide a valve passage therebetween said at least one in-folded flap member and said at least one outer flap member, from a region exterior to said valve bag apparatus to said interior region of said valve bag apparatus; and a valve tube member positioned and affixed within said valve passage, said valve tube member including at least one valve tube support member, affixed to at least one of said at least one in-folded flap member and at least one of said at least one outer flap member, said at least one valve tube support member having a first end substantially protruding sideways, exteriorly relative to said front side panel of said valve bag apparatus, and a second end extending into said valve passage, valve liner means supported by said at least one valve tube support member, for providing sealing of said valve bag apparatus, said valve liner means having a first end positioned substantially proximate to said first end of said at least one valve tube support member so as to likewise substantially protrude sideways, exteriorly relative to said front side panel of said valve bag apparatus, and a second end extending inwardly, beyond an innermost edge of the at least one in-folded flap member, to a position opening within said interior region of said valve bag apparatus, said valve liner means further including means for enabling portions of the valve liner means to be sealed to itself through application of a non-invasive, externally applied sealing force, to provide positive closure of the first end of the valve liner means, said valve liner means including at least a first layer and a second layer, so that upon application of the sealing force, the at least first and second layers of the valve liner means become sealed to one another in an elongated region, extending across the width of the valve liner means; and means, disposed within and substantially supported by said valve tube member and positioned substantially adjacent the second end of the valve tube support member, for precluding escape of said material from said valve bag apparatus, after filling of said valve bag apparatus with said material but prior to sealing of said valve bag apparatus at a location outwardly from said front side panel, said means for precluding escape of said material from said valve bag apparatus further comprising at least a portion of said valve liner means unattached to said in-folded flap member, extending into said interior region of said valve bag apparatus being unrestrained by any valve tube support member, as well as unrestrained by any portion of said at least one in-folded flap member, such that after filling of said valve bag apparatus with material, said unrestrained portion of said valve liner means being free to approach and position itself against an opposed portion of said valve liner means to preliminarily, substantially close said valve passage prior to sealing of said valve bag apparatus at said first end, wherein said valve liner means portion sealable at said first end is at least indirectly operably attached to said portion of said valve liner means at said second end to form said valve passage from said second end to and through said first end.

2. The valve bag apparatus according to claim 1, wherein said valve liner means comprises:

at least one tubular liner member, fabricated from a sealable material, disposed in said valve passage and affixed to said at least one valve tube support member.

3. The valve bag apparatus according to claim 2, wherein said at least one tubular liner member is fabricated from a polyethylene film, which is capable of being sealed by application of heat.

4. The valve bag apparatus according to claim 2, wherein said at least one tubular liner member is fabricated from a polyethylene film, which is capable of being sealed by application of ultrasonic vibrations.

5. The valve bag apparatus according to claim 1, wherein said means for precluding escape of said material from said valve bag apparatus, after filling of said valve bag apparatus with said material but prior to sealing of said valve bag apparatus comprises:

at least a portion of said valve liner means positioned in said valve passage, facing said interior region of said valve bag apparatus, and configured, such that after filling of said valve bag apparatus, said first portion of said valve liner means closes against a second portion of said valve liner means, to close off said valve passage to preclude escape of said filled material from said valve bag apparatus, prior to sealing thereof at said location protruding externally from said front side panel.

6. The valve bag apparatus according to claim 1 wherein said at least one valve tube support member comprises:

at least one first valve tube support member, being affixed to a surface of said valve liner means, between said valve liner means and said at least one outer flap member;

at least one second valve tube support member, affixed to another surface of said valve liner means, between said valve liner means and said at least one in-folded flap member.

7. The valve bag apparatus according to claim 6, wherein said at least one first valve tube support member and said at least one second valve tube support member all have first ends positioned adjacent one another, at said position protruding substantially exteriorly to said front side panel of said valve bag apparatus, said at least one first valve tube support member having a second end extending inwardly toward said interior region of said valve bag apparatus, said at least one second valve tube support member having a second end extending inwardly toward said interior region of said valve bag apparatus, said second end of said at least one first valve tube support member extending inwardly substantially further than said second end of said at least one second valve tube support member, a portion of said valve liner means facing said interior region of said valve bag apparatus being unsupported by any valve tube support member, such that after filling of said valve bag apparatus with material, said portion of said valve liner means is free to approach and position itself against an opposed portion of said valve liner means to preliminarily substantially close said valve passage prior to sealing of said valve bag apparatus.

8. The valve bag apparatus according to claim 6, wherein the at least one first valve tube support member and the at least one second valve tube support member are formed from separate sheets of material.

9. The valve bag apparatus according to claim 6, wherein the at least one first valve tube support member and the at least one second valve tube support member are formed from a single monolithic sheet of material.

10. A valve bag apparatus, for the containment of material, comprising:

a generally tubular bag body portion, having a valve end portion, said bag body portion including a front side panel;

at least one in-folded flap member, disposed in said valve end portion and extending from said front side panel inwardly into an interior region of said valve bag apparatus;

at least one outer flap member, disposed in said valve end portion, and folded to a position over and to the outside of said at least one in-folded flap member, at least a portion of said outer flap member being unadhered to at least a portion of said in-folded flap member, so as to provide a valve passage therebetween said at least one in-folded flap member and said at least one outer flap member, from a region exterior to said valve bag apparatus to said interior region of said valve bag apparatus; and a valve tube member positioned and affixed within said valve passage, said valve tube member including at least one valve tube support member, affixed to at least one of said at least one in-folded flap member and at least one of said at least one outer flap member, said at least one valve tube support member having a first end substantially protruding sideways, exteriorly relative to said front side panel of said valve bag apparatus, and a second end extending into said valve passage, valve liner means supported by said at least one valve tube support member, for providing sealing of said valve bag apparatus, said valve liner means having a first end positioned substantially proximate to said first end of said at least one valve tube support member so as to likewise substantially protrude sideways, exteriorly relative to said front side panel of said valve bag apparatus, and a second end extending inwardly, beyond an innermost edge of the at least one in-folded flap member, to a position opening within said interior region of said valve apparatus, said valve liner means further including means for enabling portions of the valve liner means to be sealed to itself in an elongated region, extending across the width of the valve liner means through application of a non-invasive, externally applied sealing force, to provide positive closure of the first end of the valve liner means; and means, disposed within and substantially supported by said valve tube member and positioned substantially adjacent the second end of the valve tube support member, for precluding escape of said material from said valve bag apparatus, after filling of said valve bag apparatus with said material but prior to sealing of said valve bag apparatus at a location outwardly from said front side panel, said means for precluding escape of said material from said valve bag apparatus further comprising a portion of said valve liner means unattached to said in-folded flap member, extending into said interior region of said valve bag apparatus being unrestrained by any valve tube support member, as well as unrestrained by any portion of said at least one in-folded flap member, such that after filling of said valve bag apparatus with material, said unrestrained portion of said valve liner means is free to approach and position itself against an opposed portion of said valve liner means to preliminarily substantially close said valve passage prior to sealing of said valve bag apparatus.

11. The valve bag apparatus according to claim 10, wherein a portion of said at least one valve tube support member is positioned between said portion of said valve liner means facing said interior region of said valve bag apparatus and being unsupported by any valve tube support member, and said interior region of said valve bag apparatus.

12. The valve bag apparatus according to claim 10, wherein no portion of said at least one valve tube support member is positioned between said portion of said valve liner means facing said interior region of said valve bag apparatus and being unsupported by any valve tube support member, and said interior region of said valve bag apparatus.

13. The valve bag apparatus according to claim 10, wherein said valve liner means comprises:

at least one tubular liner member, fabricated from a sealable material, disposed in said valve passage and affixed to said at least one valve tube support member.

14. The valve bag apparatus according to claim 10, wherein said at least one tubular liner member is fabricated from a polyethylene film, which is capable of being sealed by application of heat.

15. The valve bag apparatus according to claim 10, wherein said at least one of the tubular liner member is fabricated from a polyethylene film, which is capable of being sealed by application of ultrasonic vibrations.

16. The valve bag apparatus according to claim 10, wherein said means for precluding escape of said material from said valve bag apparatus, after filling of said valve bag apparatus with said material but prior to sealing of said valve bag apparatus comprises:

at least a portion of said valve liner means being positioned in said valve passage, facing said interior region of said valve bag apparatus, and configured, such that after filling of said valve bag apparatus, said first portion of said valve liner means closes against a second portion of said valve liner means, to close off said valve passage to preclude escape of said filled material from said valve bag apparatus, prior to sealing thereof at said location protruding externally from said front,side panel.

17. The valve bag apparatus according to claim 10 wherein said at least one valve tube support member comprises:

at least one valve tube support member, being affixed to a surface of said valve liner means, between said valve liner means and said at least one outer flap member;

at least one second valve tube support member, affixed to another surface of said valve liner means, between said valve liner means and said at least one in-folded flap member.

18. The valve bag apparatus according to claim 17, wherein said at least one first valve tube support member and said at least one second valve tube support member all have first ends positioned adjacent one another, at said position protruding substantially exteriorly to said front side panel of said valve bag apparatus, said at least one first valve tube support member having a second end extending inwardly toward said interior region of said valve bag apparatus, said at least one second valve tube support member having a second end extending inwardly toward said interior region of said valve bag apparatus, said second end of said at least one first valve tube support member extending inwardly substantially further than said second end of said at least one second valve tube support member, a portion of said valve liner means facing said interior region of said valve bag apparatus being unsupported by any valve tube support member, such that after filling of said valve bag apparatus with material, said portion of said valve liner means is free to approach and position itself against an opposed portion of said valve liner means to preliminarily close said valve passage prior to sealing of said valve bag apparatus.

19. The valve bag apparatus according to claim 17, wherein the at least one first valve tube support member and the at least one second valve tube support member are formed from separate sheets of material.

20. The valve bag apparatus according to claim 17, wherein the at least one first valve tube support member and the at least one second valve tube support member are formed from a single monolithic sheet of material.

21. A valve bag apparatus, for the containment of material, comprising:

a generally tubular bag body portion, having a valve end portion, said bag body portion including a front side panel;

at least one in-folded flap member, disposed in said valve end portion and extending from said front side panel inwardly into an interior region of said valve bag apparatus;

at least one outer flap member, disposed in said valve end portion, and folded to a position over and to the outside of said at least one in-folded flap member, at least a portion of said outer flap member being unadhered to at least a portion of said in-folded flap member, so as to provide a valve passage therebetween said at least one in-folded flap member and said at least one outer flap member, from a region exterior to said valve bag apparatus to said interior region of said valve bag apparatus; and a valve tube member positioned and affixed within said valve passage, said valve tube member including at least one valve tube support member, affixed to at least one of said at least one in-folded flap member and at least one of said at least one outer flap member, said at least one valve tube support member having a first end substantially protruding sideways, exteriorly relative to said front side panel of said valve bag apparatus, and a second end extending into said valve passage, valve liner means supported by said at least one valve tube support member, for providing sealing of said valve bag apparatus, said valve liner means having a first end positioned substantially proximate to said first end of said at least one valve tube support member so as to likewise substantially protrude sideways, exteriorly relative to said front side panel of said valve bag apparatus, and a second end extending inwardly, beyond an innermost edge of the at least one in-folded flap member, to a position opening within said interior region of said valve bag apparatus, said valve liner means including at least a first and second layer, so that upon application of a sealing force to the exteriorly extending end of the valve tube member, the at least first and second layers of the valve liner means become sealed to one another in an elongated region, extending across the width of the valve liner means, and means, disposed within and substantially supported by said valve tube member and positioned substantially adjacent the second end of the valve tube support member, for precluding escape of said material from said valve bag apparatus, after filling of said valve bag apparatus with said material but prior to sealing of said valve bag apparatus at a location outwardly from said front side panel;

the at least one valve tube support member further including a portion thereof which protrudes further outwardly than another portion of the at least one first valve tube support member, said means for precluding escape of said material from said valve bag apparatus further comprising at least a portion of said valve liner means unattached to said in-folded flap member, extending into said interior region of said valve bag apparatus being unrestrained by any valve tube support member, as well as unrestrained by any portion of said at least one in-folded flap member, such that after filling of said valve bag apparatus with material, said unrestrained portion of said valve liner means being free to approach and position itself against an opposed portion of said valve liner means to preliminarily, substantially close said valve passage prior to sealing of said valve bag apparatus at said first end, wherein said valve liner means portion sealable at said first end is at least indirectly operably attached to said portion of said valve liner means at said second end to form said valve passage from said second end to and through said first end.

* * * * *